United States Patent [19]

Gutierrez

[11] 4,328,651

[45] May 11, 1982

[54] PRECAST CONCRETE CONSTRUCTIONS

[75] Inventor: Manuel Gutierrez, Miami, Fla.

[73] Assignee: American Beverage Machinery, Inc., Miami, Fla. ; a part interest

[21] Appl. No.: 111,958

[22] Filed: Jan. 14, 1980

[51] Int. Cl.[3] ..... E02D 27/00

[52] U.S. Cl. ..... 52/293; 52/169.9; 52/295; 52/252

[58] Field of Search ..... 52/293, 294, 295, 299, 52/169.8, 169.9, 251, 252, 259

[56] References Cited

U.S. PATENT DOCUMENTS

| | | | |
|---|---|---|---|
| 3,251,165 | 5/1966 | Tyler | 52/293 |
| 3,350,826 | 11/1967 | Hughes | 52/293 |
| 3,490,186 | 1/1970 | Hammond | 52/169 |
| 3,613,325 | 10/1971 | Yee | 52/236 |
| 3,693,308 | 9/1972 | Trezzini | 52/293 |

FOREIGN PATENT DOCUMENTS

| | | | |
|---|---|---|---|
| 236542 | 5/1960 | Australia | 52/259 |
| 1017525 | 12/1952 | France | 52/259 |
| 1572843 | 8/1980 | United Kingdom | 52/251 |
| 705086 | 12/1979 | U.S.S.R. | 52/294 |

*Primary Examiner*—Price C. Faw, Jr.
*Assistant Examiner*—Henry E. Raduazo
*Attorney, Agent, or Firm*—Shapiro and Shapiro

[57] ABSTRACT

A footing box has notches for receiving an end of grooved grade beams. The end of each beam includes an aperture for receiving a reinforcing rod extending lengthwise from a grooved column supported on the ends of the beams in the footing box, to enable the grade beams and column to be unified when grout is poured into the footing box. Grooved roof beams are supported at their ends by the column and connected to the column by a reinforcing rod extending through an aperture in the end of each roof beam. Wall panels are positioned in the grooves of the column and the beams.

18 Claims, 5 Drawing Figures

PRECAST CONCRETE CONSTRUCTIONS

BACKGROUND OF THE INVENTION

The present invention relates to improvements in precast concrete constructions useful in the erection of modular prefabricated concrete structures.

Concrete constructions of precast structural elements are used for erecting low-cost concrete structures, such as buildings, houses, walls, etc. Such structures are generally more economically and more easily erected than structures constructed with conventional building techniques. These advantages may be offset, however, if special tools or equipment are required to assemble the precast elements, or if very close control over tolerances is required, such as in the positioning of supporting foundations. The more structural elements which can be prefabricated, and hence the less custom construction required on the building site, the more efficient the construction becomes. Moreover, less skilled labor is required for erecting a structure when most of the structural elements are precast.

Prefabricated constructions are known. For example, Hughes U.S. Pat. No. 3,350,826; Nov. 7, 1967, discloses a method of construction including a precast concrete wall held in slots in poured footings and precast upper beams and columns. Connection of the wall to the upper beams and the footings is by means of reinforcing bars imbedded in the wall which are grouted into openings in the beams and the footings. Trezzini U.S. Pat. No. et al. 3,693,308; Sept. 26, 1972, discloses precast wall panels connected to spaced, notched supporting blocks by pins extending between aligned holes in the blocks and the panels. Adjacent wall panels are connected together by reinforcing bars and concrete poured into spaces between adjacent panels. Hammond U.S. Pat. No. 3,490,186; Jan. 20, 1970, discloses grooved columns supported on spaced footing pads and attached thereto by dowels extending from the pads into the columns. A wall panel, which extends between the columns, fits into the column grooves. The walls are tied together at their tops by metal sheaths. After erection of the columns and the walls, a concrete grade beam is poured under the walls for support.

The known precast concrete constructions do not maximize the number of precast structural elements, nor minimize the on-site conventional construction and skilled labor requirements. It is desirable to provide precast concrete constructions having these advantages.

SUMMARY OF THE INVENTION

It is a principal object of the invention to provide a new and improved assembly for precast concrete construction.

It is also an object to provide an assembly which requires no special tools or equipment to erect.

It is a further object to provide an assembly which maximizes the number of precast structural elements and minimizes the amount of on-site conventional construction.

It is a still further object to provide a precast concrete construction which can be easily and quickly erected.

An assembly for a precast concrete construction in accordance with the invention includes a footing box having notches, each notch receiving an end of a first beam having a groove for supporting a wall panel, each beam having an aperture at its end to receive a reinforcing rod extending from a grooved column to enable unifying the beams and the column when grout is poured into the footing box.

According to more specific aspects, the ends of the beams are wedged-shaped so that the ends of beams at right angles to one another can be positioned in abutting relationship at the column with the apertures positioned to receive reinforcing rods from the column. Additionally, second grooved beams are supported on top of the column and attached thereto by a reinforcing rod extending through an aperture in the end of each beam. Wall panels are received in the grooves of the beams.

DETAILED DESCRIPTION OF THE PREFERRED EMBODIMENT

Figure 1:
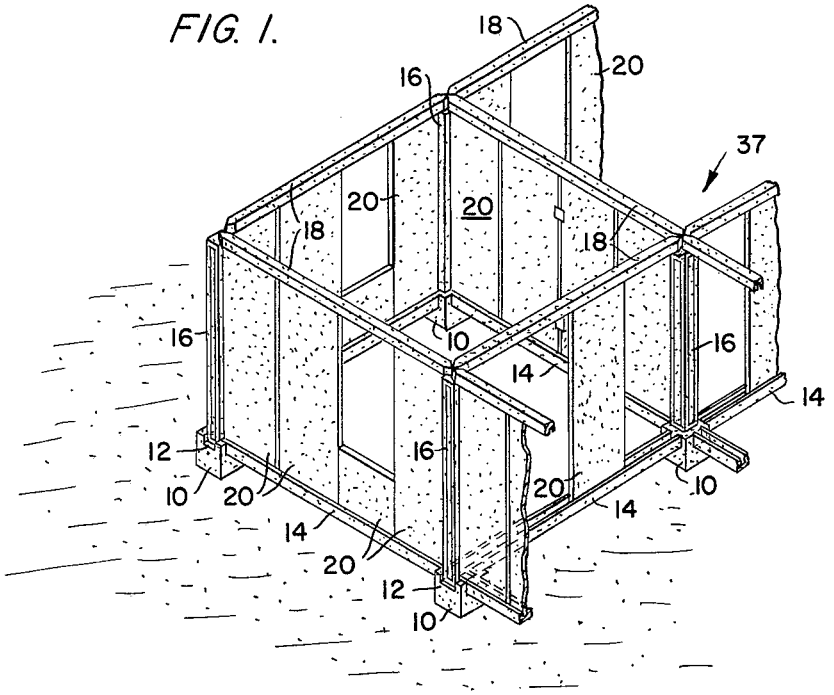
FIG. 1 is a perspective view of a portion of a modular building construction in accordance with the invention.
Figure 2:
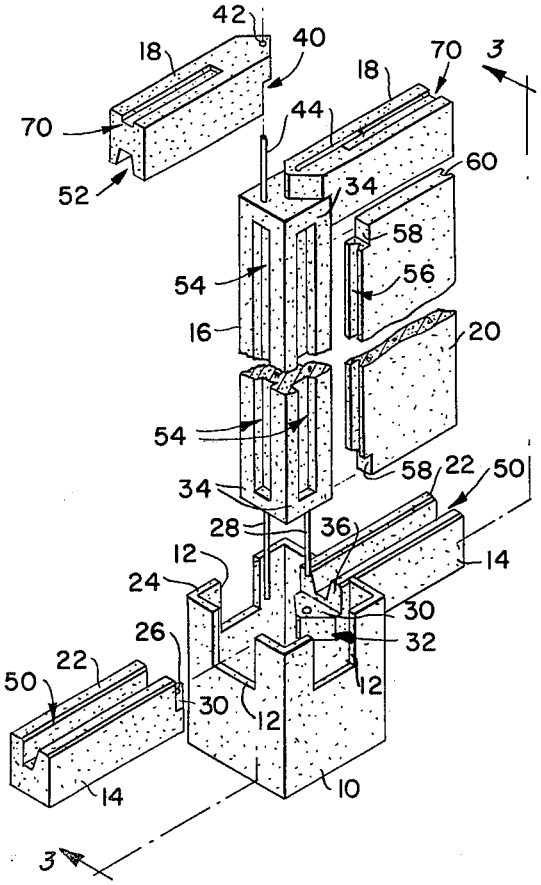
FIG. 2 is an exploded perspective view illustrating the details of certain structural elements of the assembly.
Figure 3:
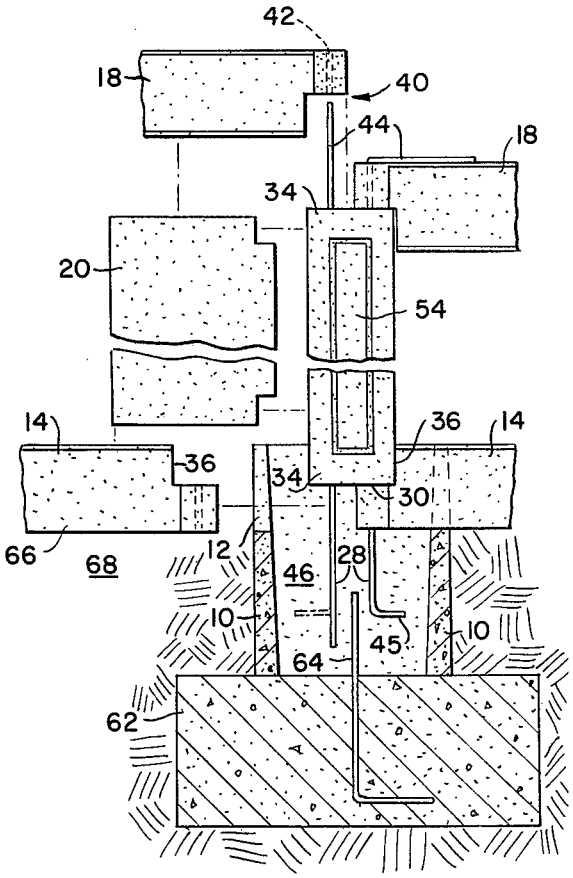
FIG. 3 is a partial sectional view taken approximately in the direction of line 3—3 of FIG. 2, illustrating additional details of the construction.

Referring to FIG. 1, a modular, precast concrete building constructed in accordance with the invention is illustrated. The assembly includes a plurality of spaced, precast concrete footing boxes 10, which may have any convenient shape such as circular, rectangular, etc., a square shape being illustrated (FIGS. 2, 4 and 5), having notches 12 in their sides. Extending between the footing boxes are precast concrete grade beams 14 having their ends received in the notches. Extending vertically from each footing box is a precast concrete column 16 supported on the ends of the grade beams received in the footing boxes. Precast concrete roof beams 18 extend between the columns and are supported at the tops of the columns (FIGS. 1–3). Between grade beams 14 and roof beams 18 a plurality of precast concrete wall panels 20 forms the walls of the building.

Figure 4:
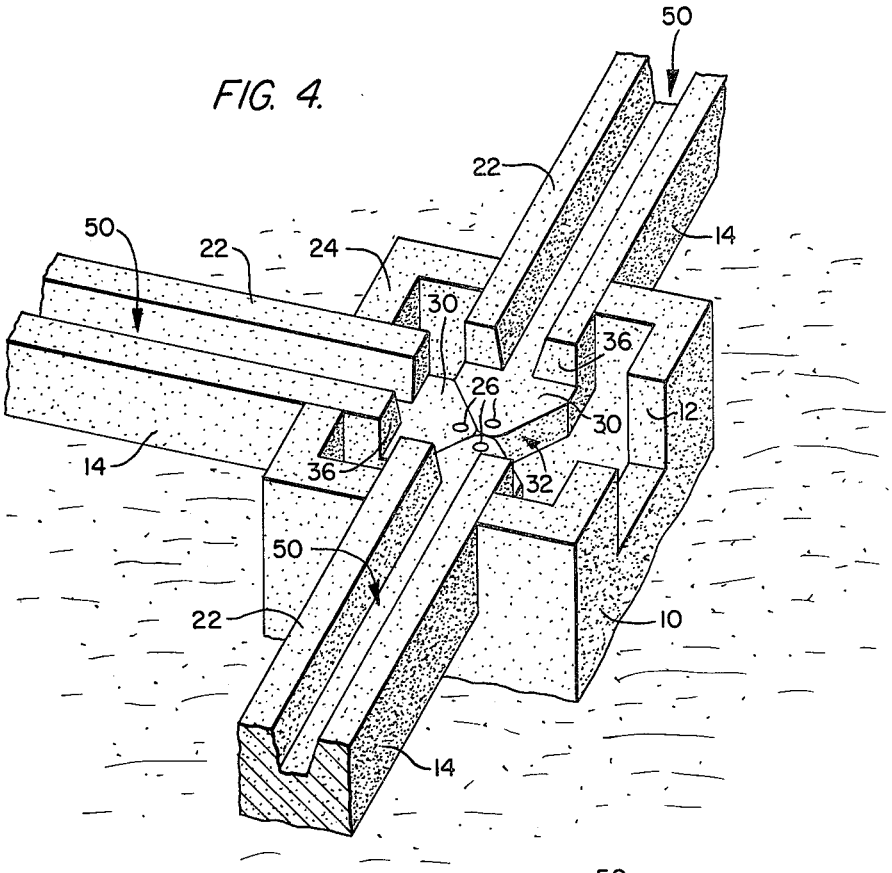
FIG. 4 is a perspective view illustrating the placement of beams in a footing box of the invention.
Figure 5:
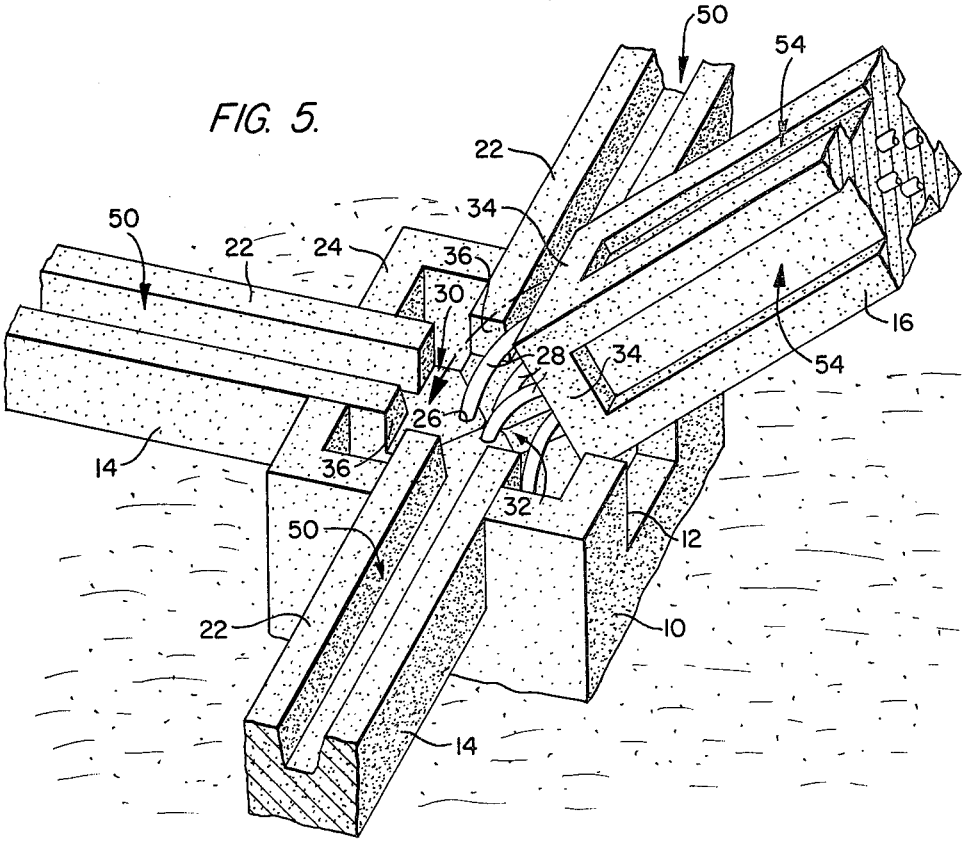
FIG. 5 is a perspective view similar to FIG. 4 illustrating the placement of a column on the beams.

Referring to FIGS. 2, 4 and 5, notches 12 are preferably U-shaped and centrally positioned in the sides of footing boxes 10. The notches are sized to receive the grade beams 14 so that the top 22 of each grade beam is level with the top 24 of the footing boxes. The end of each grade beam includes an aperture 26 therethrough for receiving a reinforcing rod 28 extending lengthwise from column 16.

The end of each grade beam is formed with a horizontal supporting ledge 30 to provide a stepped end portion 32 having a thickness approximately one-half of the thickness of the grade beam. Aperture 26 is positioned in ledge 30 adjacent to its end so that when the column is supported on ledge 30 and aperture 26 receives a reinforcing rod 28, the end portion 34 of each side of the column is in abutting relationship with a vertical face 36 at the end of the grade beam (FIG. 3). Roof beams 18 employ a stepped end configuration 40 similar to grade beams 14. The end of each roof beam has an aperture 42 for receiving a reinforcing rod 44 extending lengthwise from the opposite end (top) of column 16.

Preferably, reinforcing rods 28, 44 extend through apertures 26, 42, respectively, for a substantial distance. After a column is positioned on the grade beams 14 with the reinforcing rods 28 extending into the footing box 10, the footing box may be filled with concrete or grout 46 (FIG. 3) to unify the beams, the column and the footing box. The end portion 45 of each reinforcing rod 28 preferably is bent at substantially a right angle (FIG. 3) prior to filling the footing box with grout, to more securely anchor the column in the footing box. Reinforcing rods 44 may be bent flush with roof beams 18, generally lengthwise thereto, to connect the roof beams to the top of the column (FIGS. 2 and 3). Thereafter, the joint may be covered with a light concrete mixture to unify the connection between the roof beams and the column.

As illustrated in FIGS. 2, 4 and 5, the stepped end portions 32, 40 of the grade beams and roof beams are preferably wedged-shaped, so that two beams may be placed at a right angle to one another with their ends abutting at a column. The wedge-shaped ends allow any desired number of beams to be connected to each end of the column. For example, four beams may be placed in abutting relationship at right angles to one another, as for the juncture of four (4) interior walls (37 in FIG. 1), or three beams may form a "T" configuration (FIGS. 4 and 5), so that the apertures 26, 42 in their ends may recieve the reinforcing rods extending from a column. For clarity, only two reinforcing rods 28, 44 are illustrated extending from each end of column 16 in FIGS. 2 and 3. However, it is to be understood that preferably column 16 is formed with four reinforcing rods extending from each end thereof, as shown in FIG. 5, so that up to four beams can be joined at each column. Similarly, the footing boxes are preferably formed with four notches, one in each side (FIGS. 2, 4 and 5), to receive four beams. This allows a single design for each of the grade beams, roof beams, columns and footing boxes.

Grade beams 14 and roof beams 18 are each formed with a longitudinal slot or groove 50, 52, respectively, for receiving wall panels 20 positioned between the roof and grade beams. Grooves 50, 52 of the beams may be filled with grout after the wall panels are inserted, to unify the connection between the wall panels and the beams. A groove 54 is also formed longitudinally in each side of column 16 for receiving the vertical edge of a wall panel. As illustrated particularly in FIG. 2, grooves 54 preferably extend substantially the entire length of the column. The edge of the wall panel received in column groove 54 may also have a groove 56 which may be filled with grout when the wall panel is positioned in column groove 54, to unify the connection between the column and the wall panel. Notched portions 58 at each end of groove 56 allow the edge of the wall panel to be inserted in groove 54 so that the notched ends of the wall panel are flush with the side of the column at its top and bottom end portions 34 (FIG. 3). A longitudinally extending groove 60 may be also formed along the opposite edge of the wall panel from groove 56. A similar groove preferably is formed along the mating edge of an adjacent wall panel, not illustrated, so that grout may be inserted between adjacent wall panels to connect them together and form a seal.

It is an advantage of the invention that all of the structural elements are precast concrete and may be assembled without special tools or equipment. The beams, columns, footing boxes, and wall panels may all be formed by pouring concrete into molds, as is well known. Furthermore, during precasting, the various structural elements may be reinforced with internal reinforcing rods or bars, as is also well known.

It is now appropriate to describe a concrete construction using the structural elements of FIGS. 2 and 3. The footing boxes 10 are first located in appropriate spaced positions at the building site. Preferably, each footing box is supported on a below-grade, pre-poured concrete footing pad 62, which may have a reinforcing rod 64 extending upwardly therefrom, as illustrated in FIG. 3. Positioning of the footing pads can be facilitated with a portable jig to locate their centers, in a well-known manner. The reinforcing rod 64 permits the footing box to be securely anchored to the footing pad when the box is filled with grout or concrete 46. The depth below grade of footing pad 62 is preferably such that the base 66 of each grade beam is at ground level and in contact with well-compacted earth 68.

Next, grade beams are positioned between the footing boxes and the columns erected thereon with reinforcing rods 28 extending through corresponding apertures 26 in the grade beams. As illustrated in FIG. 5, a column may be conveniently erected upon the grade beams by positioning the end of the column in the footing box with the column inclined somewhat with respect to the ground, so that the reinforcing rods 28 may be bent (preferably they are flexible enough for this purpose) and guided through apertures 26 in the ends of the grade beams. If, for example, there are only three grade beams in the footing box, the fourth reinforcing rod from the end of the column may be bent into the footing box, as shown in FIG. 5. The column may then be raised into position, supported on the ledge portions 30 of the grade beams. The end 45 of each reinforcing rod may then be bent as shown in FIG. 3. The column may then be trued, and shored in position with temporary supports, such as lumber. The footing boxes are then filled with concrete or grout 46, which is allowed to harden for several days. This will tie together the footings 62, footing boxes 10, grade beams 14, and columns 16 as a unified structure.

Wall panels may then be installed in grooves 50 in the grade beams. The panels adjacent to the columns are installed first. The intermediate panels can then be positioned in the grooves 50 of the grade beams. Temporary shoring may be used to hold the panels in position. The roof beams are next positioned on the columns so that the tops of the wall panels are received in grooves 52. Reinforcing rods 44 extending through apertures 42 of the roof beams may then be bent over and the joints covered with a light concrete mixture. Thereafter, an appropriate roof and floor completes the construction.

To facilitate the installation of electrical wiring, roof beams 18 may have grooves 70 in their top surface, into which electrical wiring can be laid. Electrical wiring for wall outlets, etc., may be placed in grooves 60 between adjacent wall panels 20 prior to grouting and connected to the wiring in groove 70.

The wall panels 20, which may have different widths and heights to accommodate doors and windows, preferably have widths substantially less than the length of the beams so that a number of wall panels is required to form a complete wall. By restricting the widths of the panels, they are made lighter and easier to handle. In addition, greater flexibility is permitted in providing openings for windows and doors in the walls.

Precast concrete constructions in accordance with the invention have been found to be easily and quickly erected, yet sturdy enough to withstand severe weather conditions such as earthquakes and hurricanes. Moreover, the beams, columns and wall panels are basically self-aligning due to their interlocking design, and the positions of the footing boxes can be easily adjusted prior to filling with grout. This permits the use of relatively unskilled labor, which minimizes construction costs.

While the foregoing description has been directed to a particular embodiment, it will be appreciated by those skilled in the art that variations are possible without departing from the principles and spirit of the invention, the scope of which is defined by the appended claims.

What is claimed is:

1. A precast concrete construction comprising a pair of grade beams, each beam having a groove adapted for receiving a wall panel, a footing box having notches, each notch adapted to receive an end of a grade beam, a column supported on said ends, each beam having an aperture at its end to receive a reinforcing rod extending from the column and into the footing box to enable unifying the beams and the column when grout is poured into the footing box, and a roof beam supported on the top of the column, the roof beam having an aperture for receiving a reinforcing rod extending from the top of the column to enable unifying the column and the roof beam.

2. The construction of claim 1, wherein the end of each grade beam is wedged-shaped so that the beams can be positioned at substantially right angles to one another beneath the column.

3. The construction of claim 1, wherein the column is adapted to receive the edge of a wall panel positioned within a groove of the column, the edge of the wall panel received in the column groove being grooved to receive grout for unifying the wall panel and the column.

4. The construction of claim 3, wherein the roof beam is grooved to receive a wall panel and the construction further comprises a plurality of wall panels positioned in the groove of each beam, the opposing edges of adjacent wall panels each having a groove for receiving grout to unify the wall panels.

5. The construction of claim 4, wherein the roof beam has a another groove along a side opposite to the first-mentioned groove.

6. The construction of claim 1, wherein the reinforcing rods extending from the column are formed integrally with the column and are sized to extend a substantial distance through the apertures in the beams.

7. The construction of claim 6, wherein the roof beam is supported on the column at its end, and the end of the roof beam is wedged-shaped so that two roof beams can be placed at substantially right angles to one another at the column.

8. The construction of claims 2 or 6, wherein the end of each beam is stepped, having a ledge abutting an end of the column and a surface at substantially a right angle to the ledge abutting a side of the column, the aperture being positioned in the ledge.

9. The construction of claim 1, wherein the notches in the footing box are substantially U-shaped and sized with respect to the grade beams such that the tops of the beams are positioned at the top of the footing box.

10. The construction of claim 9, wherein the footing box contains notches in each of four sides for receiving up to four grade beams.

11. The construction of claim 1, wherein the reinforcing rod is sized to extend through the aperture of a grade beam a substantial distance into the footing box and the footing box is sized to enable the reinforcing rod to be bent prior to filling the footing box with grout.

12. A precast concrete construction comprising a pair of footing boxes, each having a notch, a grooved grade beam having its ends received in the notches, a grooved column supported on each end of the beam, each column having a reinforcing rod extending through an aperture in the end of the beam and into the footing boxes to enable the columns and the beam to be unified when grout is poured into the footing boxes, a grooved roof beam having its ends supported at the tops of the columns and having apertures in each of its ends for receiving a reinforcing rod extending from the tops of the columns for unifying the columns and the roof beam, and a plurality of wall panels positioned in the grooves of the columns and the beams.

13. The construction of claim 12, wherein the edges of the wall panels received in the column grooves are grooved to enable the wall panels and the columns to be unified when grout is poured into the grooves of the wall panels.

14. The construction of claim 12, wherein the footing boxes have a plurality of notches for receiving additional grooved grade beams, and wherein the ends of the grooved grade beams received in the notches are cooperatively shaped to enable beams received in the notches to extend substantially perpendicular to one another with their ends in abutting relationship beneath a column and positioned to receive reinforcing rods extending from the column in apertures in the abutting ends.

15. The construction of claim 14, wherein the ends of the grade and the roof beams are wedged-shaped so that the ends of four beams may be placed in abutting relationship at the columns.

16. The construction of claim 15, wherein the ends are stepped having a ledge abutting an end of a column and a portion adjacent to the ledge abutting a side of the column, the aperture receiving the reinforcing rod being positioned in the ledge adjacent to the end of the beam.

17. The construction of claim 12, wherein the footing boxes support the bottom of the grade beam at ground level.

18. The construction of claim 12, wherein the wall panels, the beams, and the columns are sized such that when they are assembled and unified, the wall panels, the beams and the columns are interlocked and form a wall of a building.

* * * * *